US006390851B1

(12) United States Patent
Belopolsky et al.

(10) Patent No.: US 6,390,851 B1
(45) Date of Patent: May 21, 2002

(54) ELECTRICAL CONNECTOR WITH INTERNAL SHIELD

(75) Inventors: Yakov Belopolsky, Harrisburg; William A. Northey, Etters, both of PA (US)

(73) Assignee: Berg Technology, Inc., Reno, NV (US)

( * ) Notice: Subject to any disclaimer, the term of this patent is extended or adjusted under 35 U.S.C. 154(b) by 0 days.

(21) Appl. No.: 09/419,735

(22) Filed: Oct. 16, 1999

(51) Int. Cl.[7] ..... H01K 13/648; H01K 24/00; H01R 33/46

(52) U.S. Cl. ..... 439/607; 439/676; 439/939

(58) Field of Search ..... 439/607, 676, 439/626, 939, 609, 608, 610

(56) References Cited

U.S. PATENT DOCUMENTS

| | | | | |
|---|---|---|---|---|
| 2,163,412 A | | 6/1939 | Schneider | |
| 2,476,886 A | | 7/1949 | Miller et al. | |
| 3,728,787 A | | 4/1973 | McDonough | |
| 4,202,593 A | | 5/1980 | Abernethy et al. | |
| 4,650,723 A | | 3/1987 | Furuya | |
| 4,662,702 A | | 5/1987 | Furuya | |
| 4,859,201 A | | 8/1989 | Marsh | |
| 4,863,393 A | | 9/1989 | Ward et al. | |
| 4,874,333 A | | 10/1989 | Reed | |
| 4,878,858 A | * | 11/1989 | Dechelette | 439/607 |
| 4,921,430 A | | 5/1990 | Matsuoka | |
| 4,969,842 A | | 11/1990 | Davis | |
| 5,035,651 A | | 7/1991 | Dixon et al. | |
| 5,123,854 A | | 6/1992 | Petersen et al. | |
| 5,131,865 A | | 7/1992 | Taguchi et al. | |
| 5,169,321 A | | 12/1992 | Matsuoka | |
| 5,195,911 A | * | 3/1993 | Murphy | 439/607 |
| 5,312,273 A | | 5/1994 | Andre et al. | |
| 5,378,172 A | * | 1/1995 | Roberts | 439/607 |
| 5,399,107 A | | 3/1995 | Gentry et al. | |
| 5,496,195 A | | 3/1996 | Reed | |
| 5,509,823 A | | 4/1996 | Harting et al. | |
| 5,513,065 A | | 4/1996 | Caveney et al. | |
| 5,531,606 A | | 7/1996 | Rodigues et al. | |
| 5,531,612 A | | 7/1996 | Goodall et al. | |
| 5,542,853 A | | 8/1996 | Bouchan | |
| 5,547,405 A | | 8/1996 | Pinney et al. | |
| 5,564,948 A | | 10/1996 | Harting et al. | |
| 5,571,035 A | | 11/1996 | Ferrill | |
| 5,586,914 A | | 12/1996 | Foster et al. | |
| 5,597,326 A | | 1/1997 | DeLessert et al. | |
| 5,599,209 A | | 2/1997 | Belopolsky | |
| 5,647,770 A | | 7/1997 | Belopolsky | |
| 5,687,478 A | | 11/1997 | Belopolsky | |
| 5,718,606 A | | 2/1998 | Rigby et al. | |
| 5,736,910 A | | 4/1998 | Townsend et al. | |
| 5,772,472 A | | 6/1998 | Beutler et al. | |
| 5,788,538 A | * | 8/1998 | Belopolsky et al. | 439/607 |
| 6,065,985 A | | 5/2000 | Marshall | |
| 6,077,120 A | * | 6/2000 | Futatsugi et al. | 439/607 |

FOREIGN PATENT DOCUMENTS

| | | |
|---|---|---|
| EP | 0 963 007 A1 | 8/1999 |
| GB | 2 329 530 | 3/1989 |

* cited by examiner

*Primary Examiner*—Paula Bradley
*Assistant Examiner*—Edwin A. León
(74) *Attorney, Agent, or Firm*—Steven M. Reiss; M. Richard Page

(57) ABSTRACT

An electrical connector has an insulating housing with an interior cavity for receiving a mating connector and a plurality of openings in communication with the interior cavity. A plurality of contacts, each of. which extends into the interior cavity of the housing from a respective one of the openings, electrically contacts conductors in the mating connector inserted into the interior cavity of the housing. An internal shield extends into the interior cavity from a respective one of the openings and is positioned between the plurality of contacts to create at least two groups of contacts.

39 Claims, 9 Drawing Sheets

ELECTRICAL CONNECTOR WITH INTERNAL SHIELD

CROSS-REFERENCE TO RELATED APPLICATIONS

The present invention is related to U.S. patent application Ser. No. 09/419,734 filed on Oct. 16, 1999, herein incorporated by reference.

BACKGROUND OF THE INVENTION

1. Field of the Invention

The present invention relates to an internal shield device for an electrical connector such as a modular jack. More particularly, the present invention relates to such an internal shield whereby groups of contacts within the jack are electrically shielded from one another.

2. Brief Description of Earlier Developments

Presently, a modular jack is almost universally employed as the input/output connector system for premises wiring (for example). Most voice and data communications equipment, including telephones, facsimile machines, modems, local networks, and switches utilize such modular jack connectors. In the jack, a plurality of contacts are arranged in a generally linear fashion in the jack interior. Initially, the performance of modular jacks limited their use to relatively lower speed applications, where cross-talk between signals on the contacts is not a significant issue.

However, a need has arisen for the jack connector in higher speed applications. As a result, various curative measures have been employed to address such cross-talk. For example, it is known that arranging contacts into contact pairs (signal and return) can reduce cross-talk. Likewise, various physical arrangements of contacts and pairs of contacts can reduce cross-talk, as can employing specific designs for each contact in a pair of contacts. In addition, filtering elements may be added to the connector.

A need still exists, though, for such an electrical connector that can adequately minimize cross-talk at relatively higher data speeds. Ideally, such connector should have a relatively simple design and should accept a conventional connector.

SUMMARY OF THE INVENTION

The aforementioned need is satisfied by the present invention, in which an electrical connector has an insulating housing with an interior cavity for receiving a mating connector and a plurality of openings in communication with the interior cavity. A plurality of contacts, each of which extends into the interior cavity of the housing from a respective one of the openings, electrically contacts conductors in the mating connector inserted into the interior cavity of the housing. An internal shield extends into the interior cavity from a respective one of the openings and is positioned between the plurality of contacts to create at least two groups of contacts.

In one embodiment of the present invention, a modular jack has an insulating housing with an interior cavity and generally opposing side faces, and an insulative insert with a forward portion, where the insert is mounted within the interior cavity of the insulating housing. A plurality of first contacts are mounted to the forward portion of the insert and extend into the interior cavity of the housing to electrically contact conductors in a connector inserted into the interior cavity of the housing and toward the forward portion of the insert.

Each first contact in the area of the forward portion generally resides in a plane generally parallel to the opposing side faces of the housing. The first contacts are organized into a plurality of groups, where each group comprises a number of immediately adjacent first contacts. The forward portion of the insert defines a number of possible contact positions within which each first contact may reside, and each group is separated from an immediately adjacent group by at least one unused contact position.

The jack also has a conductive internal shield device that includes at least one separator residing in an unused contact position and in a plane generally parallel to the plane of each first contact. Accordingly, the separator shields a pair of immediately adjacent groups from one another.

BRIEF DESCRIPTION OF THE DRAWINGS

The filtered modular jack assembly of the present invention is further described with reference to the accompanying drawings in which.

DETAILED DESCRIPTION OF THE PREFERRED EMBODIMENTS

Referring now to FIGS. 1–5, wherein like numerals are used to indicate like elements throughout, one type of modular jack is shown for purposes of disclosing typical features in modular jacks. As will be seen in FIGS. 6–8B, wherein like numerals are also used to indicate like elements throughout, the modular jack of the present invention could share many common features with the modular jack shown in FIGS. 1–5. The present invention, however, is not limited to use in the specific connector shown in the figures.

Figure 1:
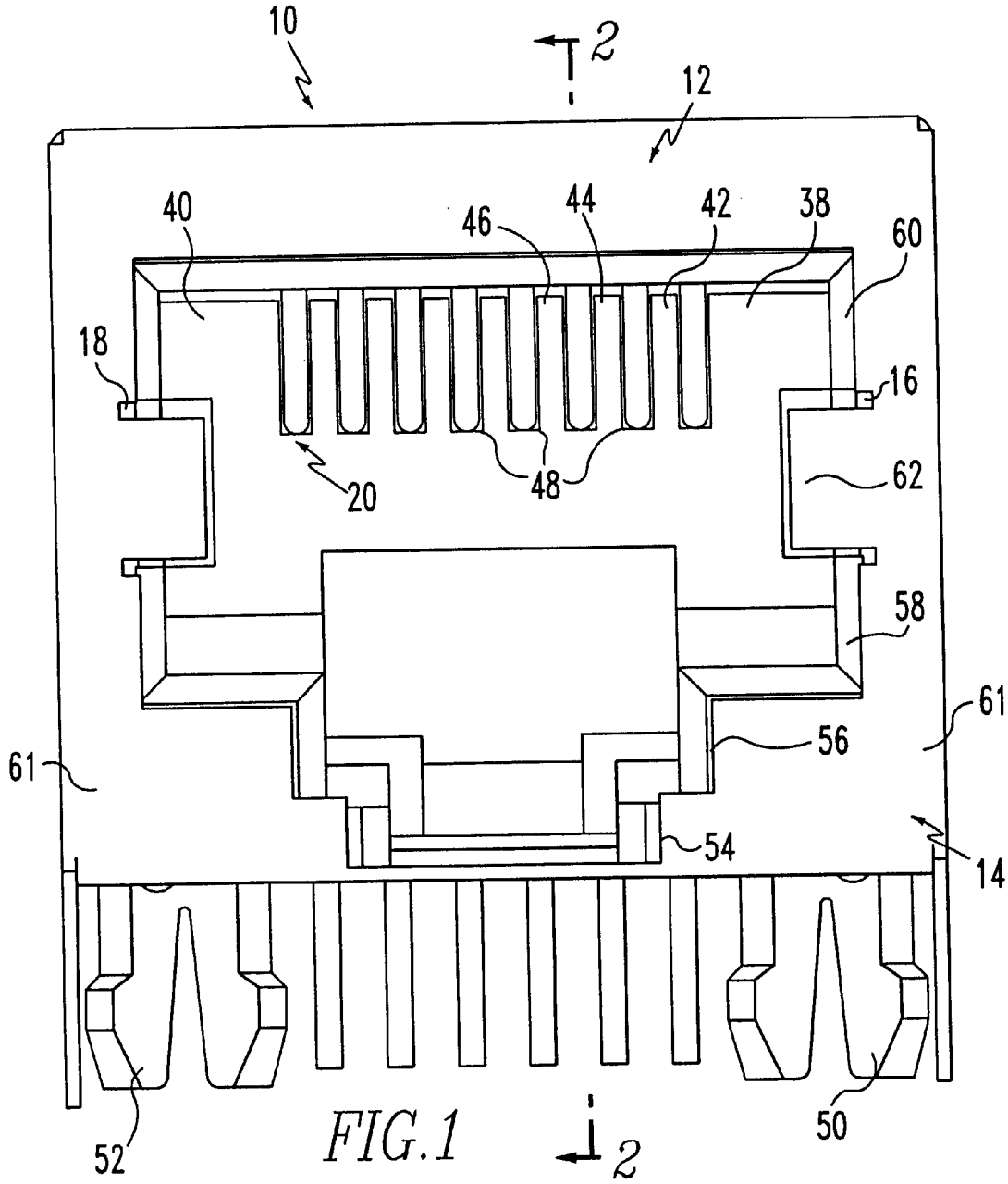
FIG. 1 is a front elevational view of one type of modular jack.
Figure 2:
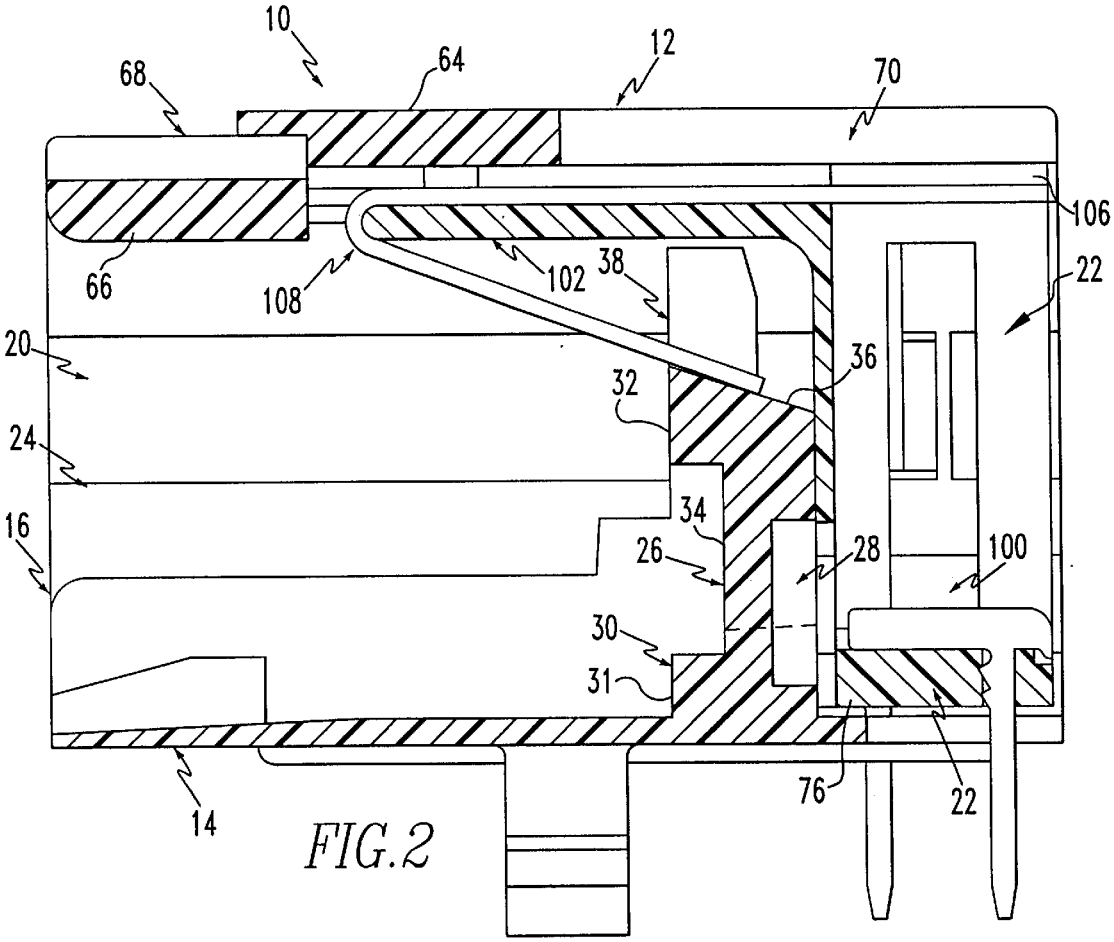
FIG. 2 is a cross sectional view through 2—2 in FIG. 1 in which for the purpose of showing other detail, shielding, a filter, and associated wires and a rear cap have been deleted.

As seen in FIGS. 1 and 2, the modular jack has an outer insulative housing which is shown generally at numeral 10.

This housing includes a top wall 12, a bottom wall 14 and a pair of opposed lateral walls 16 and 18. The housing could be constructed of a thermoplastic polymer having suitable insulative properties and may have conventional metallic exterior shielding 61. Within these walls is an interior section 20 which has a rear open end 22 and a forward open end 24. Projecting upwardly from the bottom wall in this interior section there is a medial wall generally shown at numeral 26 which has a rear side 28 and a front side shown generally at numeral 30 which includes a bottom front side 31, a top front side 32, a recessed medial front side 34, and an inclined top side 36 which slopes upwardly and forwardly from its rear side toward its front side. Adjacent to the lateral walls, the medial wall has lateral extensions 38 and 40 which serve as projections to retain other elements as will be hereafter explained. Interposed between these lateral extensions there are a plurality of wire separation extensions as at 42, 44 and 46 and between these wire separation extensions there are plurality of slots as at 48.

Figure 3:
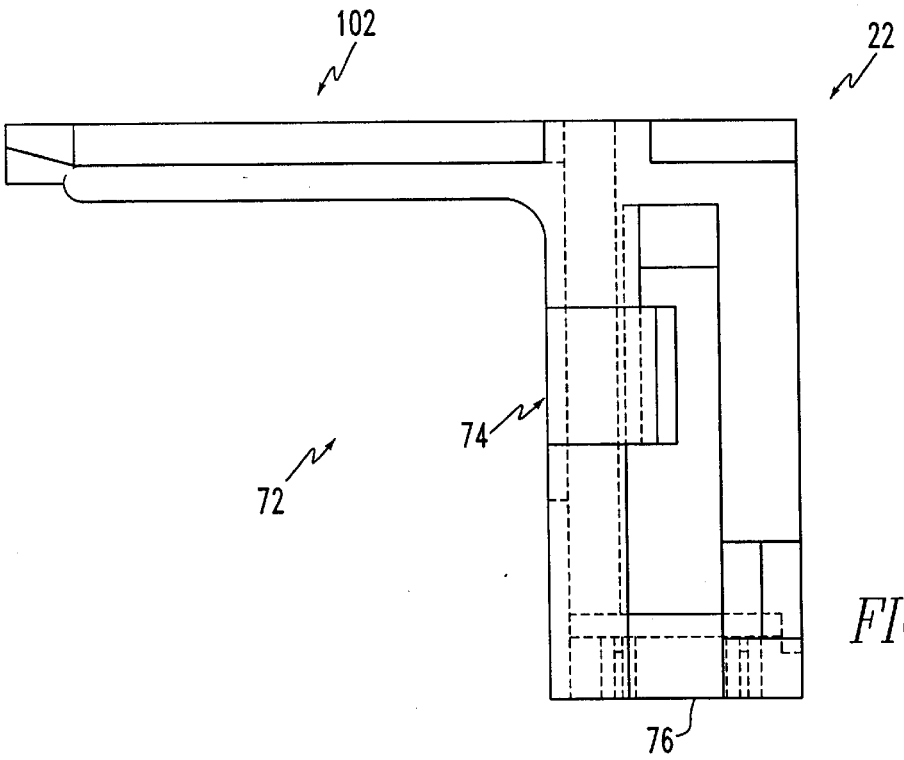
FIG. 3 is a side elevational view of an insulative insert used in the modular jack shown in FIG. 1.
Figure 4:
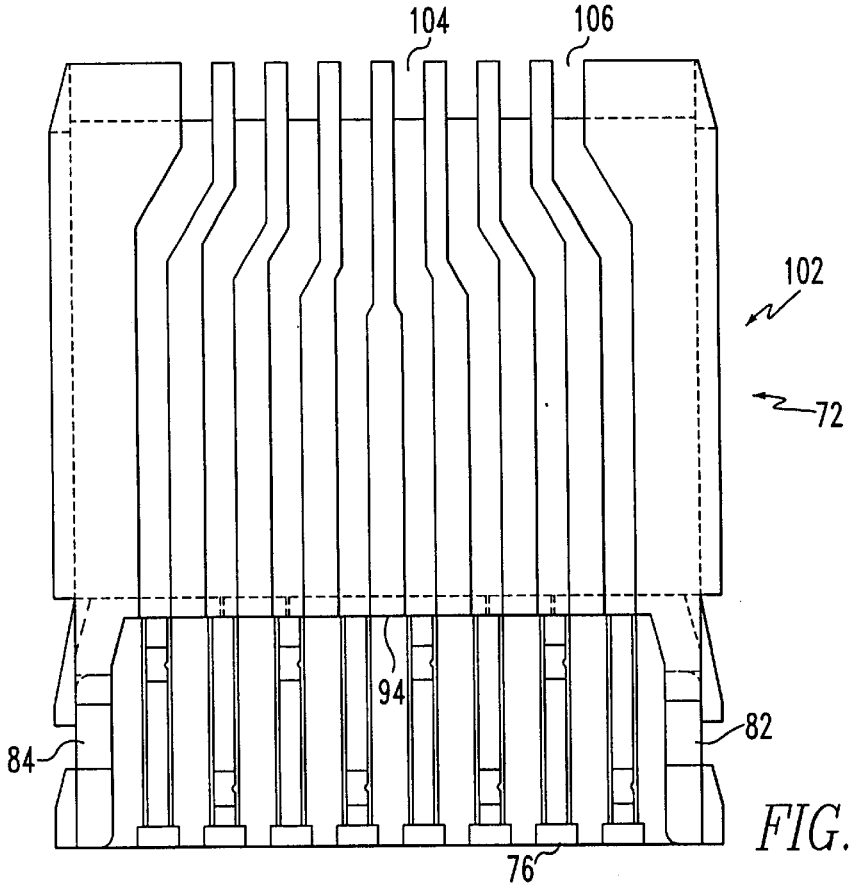
FIG. 4 is a top plan view of the insulative insert shown in FIG. 3.

As will be appreciated by those skilled in the art and as further explained hereafter, the wall and recesses of the outer insulative housing may interact to receive an insulative insert 72 (best seen in FIGS. 3 and 4). One type of insert (such as the insert shown in FIG. 6C) includes all of the terminals used by the modular jack. In the modular jack shown in FIGS. 1–5, however, housing 10 has terminals that correspond to the terminals on insert 72 so as to make electrical connection between the conductors in the housing 10 and the insert 72. Importantly, the housing 10 and the insert 72, rather than being separate elements, may be formed as a substantially unitary body without departing from the spirit and scope of the present invention.

Extending downwardly from the bottom wall there are alignment and retention posts 50 and 52 for mounting to a PCB. The lateral wall 16 includes a lower shoulder 54, another shoulder 56, a lower main wall 58, an upper main wall 60 and a recess interposed between the lower and upper main wall that accepts a tab 62 from external shield 61 when the insertion of a plug (FIG. 6A) into the modular jack receptacle deflects tab 62. It will be seen that the lateral wall 18 has substantially identical features as lateral wall 16. The top wall 12 includes an upper bridge section 64, a lower bridge section 66, a front recess 68 and a rear recess 70.

Referring particularly to FIGS. 3 and 4, the insulative insert which may be received by the housing 10 is shown generally at numeral 72. This insert 72 has a vertical section shown generally at numeral 74 which includes a base wall 76. The vertical section also includes opposed side walls 82 and 84. The vertical section also has a front wall 94 in which there are apertures 96 and 98. Finally the vertical section 74 of the insert 72 could define a recess 100. The insert also has a horizontal section shown generally at numeral 102 which has a plurality of grooves as at groove 104 and 106 which extend from the rear to the front of this horizontal section. In these grooves there are conductors as at wire 108 (FIG. 2).

Figure 5:
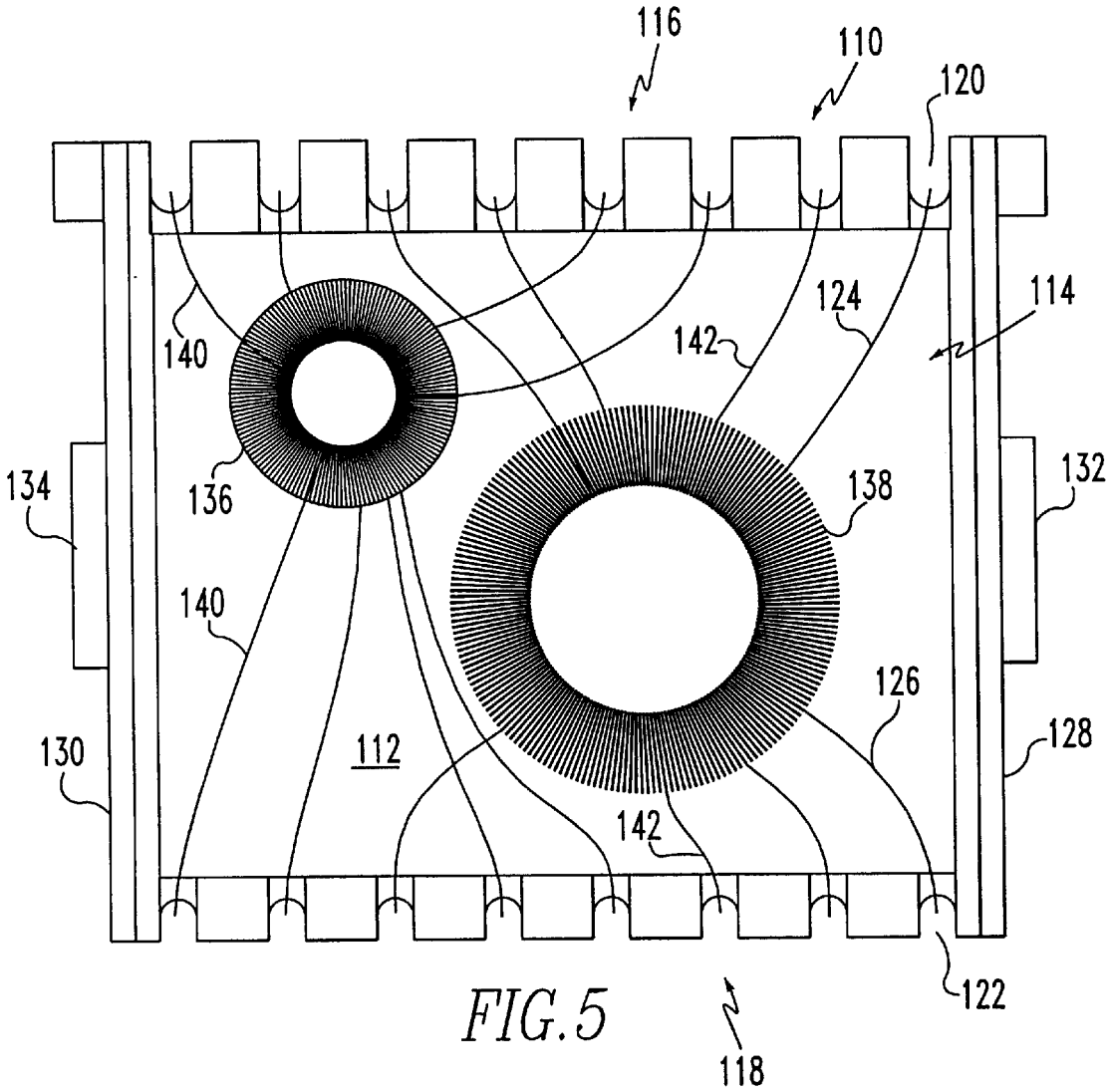
FIG. 5 is an interior view of a cap element used in the modular jack shown in FIG. 1.

Referring particularly to FIG. 5, a cap element which may be mounted to the insert 72 is shown generally at numeral 110. This cap element 110 has a rear wall 112 and defines a recess 114 therein. The cap also has a top end wall 116 and a bottom end wall 118 which have respectively grooves as at groove 120 and 122. Conductors as at wire 124 and 126 are positioned in each of these grooves. The cap also has side walls 128 and 130 which have respectively latches 132 and 134 for engaging the side walls 82 and 84 of the insulative insert. A filter means such as common mode chokes 136 and 138 may be mounted on the inner or recess side of the wall 112, as is more fully discussed in U.S. patent application Ser. No. 08/863,654, hereby incorporated by reference. Other filtering elements known to those skilled in the art such as inductive serial filters, differential filters, low pass capacitive filters and other magnetic filters may be substituted for the common mode choke. It will be appreciated that in the modular jack as shown in FIGS. 1–5, each groove 104, 106 in the horizontal section 102 of the insert 72 is filled with a wire or first contact 108, for a total of eight first contacts 108 arranged in a generally linear manner in a highly compact space. Referring now to FIGS. 6–8B, it is seen that in contrast to the jack of FIGS. 1–5, the jack of the present invention includes a number of unused grooves or contact positions, where the unused contact positions define borders or buffers between a number of groups of first contacts. In the present invention, cross-talk between such groups is minimized by placing a conductive internal shield device in an unused contact position, whereby the separator shields a pair of immediately adjacent groups from one another. In empirical tests, it has been found that the reduction in cross-talk using such internal shield is so significant that at least some other typically employed cross-talk remedies may be dispensed with.

The modular jack 200 of the present invention could be similar to the jack shown in FIGS. 1–5 in that such jack 200 has an insert (FIG. 6C) mounted within an interior cavity 202 of an insulating housing 10. In such a situation, the insert may define a recess for receiving a filter element or the like therein, although such recess and filter or the like are not necessary in terms of the present invention. Furthermore, even the use of a separate insert is unnecessary to carry out the present invention. The present invention could also be used in a single piece housing.

In terms of the embodiments shown, the insert 72 may be defined to include a forward portion 204 (i.e., the horizontal section 102 in FIGS. 1–5, generally), and a plurality of first contacts 206 are mounted to the forward portion 204 of the insert 72 and extend into the interior cavity 202 of the housing 10. However, other arrangements are possible. The first contacts 206, as is to be understood, are for electrically contacting corresponding conductors (not shown) in a connector 208, such as a plug having a plurality of conductors therein, when such connector 208 is properly inserted into the interior cavity 202 of the housing 10 and toward the forward portion 204 of the insert 72.

Figure 6:
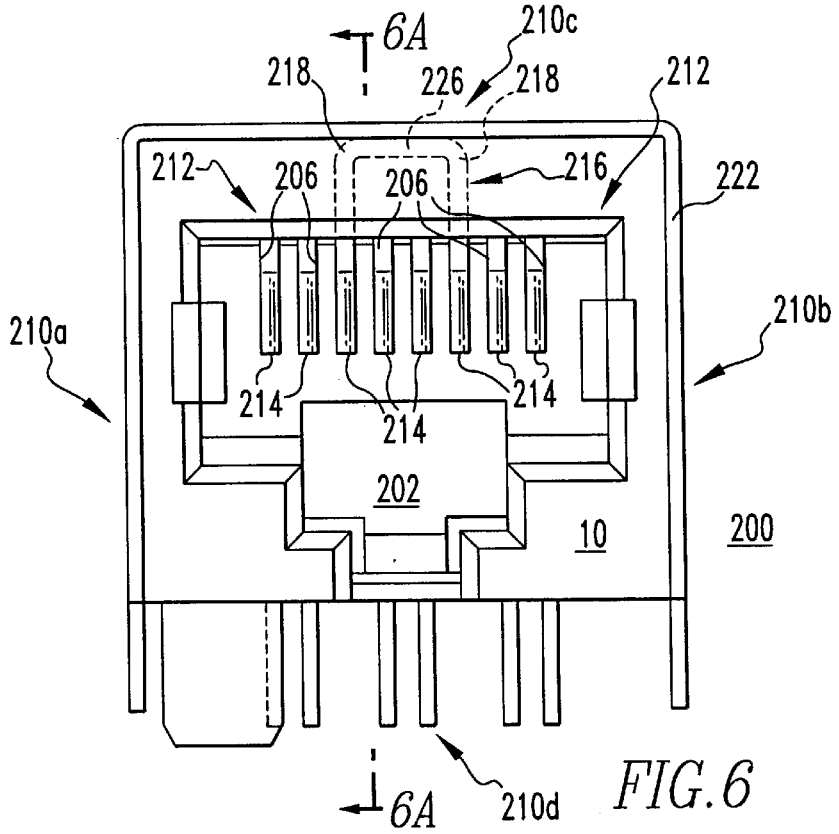
FIG. 6 is a front elevational view of a modular jack with internal shield device in accordance with a first embodiment of the present invention.
Figure 6A:
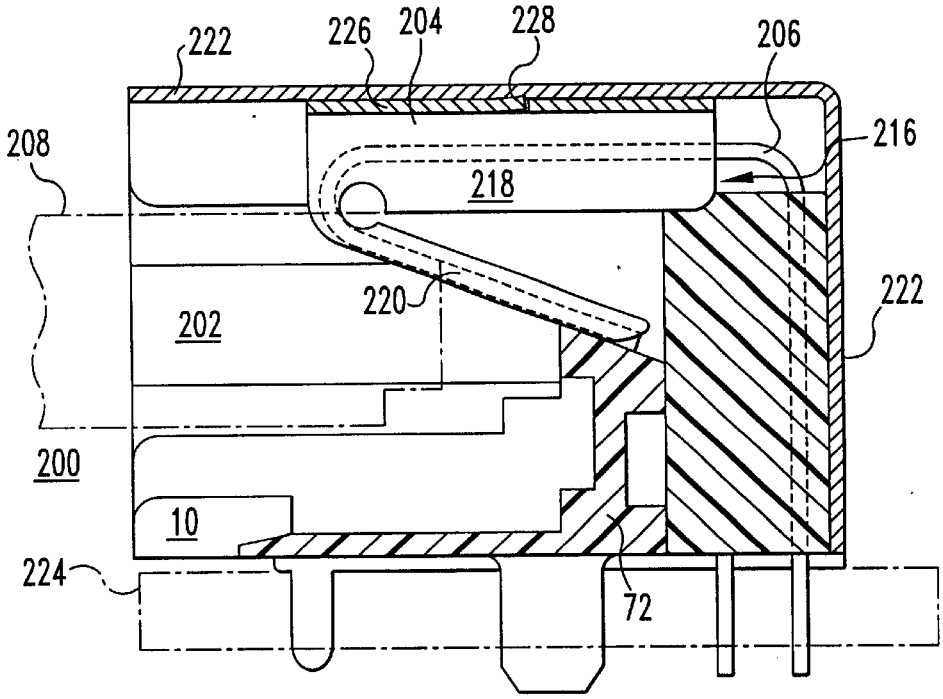
FIG. 6A is a cross-sectional view taken along the line 6A—6A in FIG. 6.

As seen in FIGS. 6 and 6A, the housing 10 and jack 200 have generally opposing side faces 210*a*, 210*b*, and generally opposing upper and lower faces 210*c*, 210*d* that generally interconnect the side faces 210*a*, 210*b*. As also seen, each first contact 206 in the area of the forward portion 204 generally resides in a plane generally parallel to the opposing side faces 210*a*, 210*b*. Any type of appropriate first contact 206 may be employed in the jack 200 without departing from the spirit and scope of the present invention, as long as the employed first contact 206 is capable of performing the necessary functions as described herein.

For example, the first contacts 206 may be so-called 'long' first contacts 206 that, beginning with the mating end, extend from beneath the forward portion 204 of the insert 72 up and over to the top side of the forward portion 204, and then to the rear of the jack 200, as is seen in FIG. 6A. Likewise, the first contacts 206 may be so-called 'short' first contacts 206 that, beginning with the mating end, extend from above the forward portion 204 of the insert 72 down and around to the bottom side of the forward portion 204, and then to the rear of the jack 200 (not shown). Moreover, multiple types of first contacts 206, including long, short, and other varieties, may be employed simultaneously, again without departing from the spirit and scope of the present invention. U.S. Pat. No. 5,687,478, herein incorporated by reference, describes the use of 'long' and 'short' contacts in a modular jack receptacle.

As best seen in FIG. 6, the. first contacts 206 are organized into a plurality of groups 212, where each group 212 comprises a number of immediately adjacent first contacts 206. Each group may have a like number of first contacts 206, or may likewise have a different number of first contacts. Moreover, the number of first contacts 206 in a group may be as little as one, although it is more typical that such groups will have at least two first contacts 206. As shown, the forward portion 204 of the insert 72 defines a number of possible contact positions 214 within which each first contact 206 may reside. Importantly, not all of the contacts positions 214 are loaded with contacts 206. Accordingly, at least one of the possible contact positions 214 is unused or unoccupied by a first contact 206 (two are unoccupied by contacts as seen in FIG. 6). Preferably, each group 212 is separated from an immediately adjacent group 212 by at least one unused contact position 214. The unused positions can be loaded with a shield as described in more detail below.

In one embodiment of the present invention, each possible contact position 214 is embodied as a contact channel 214 in the top side of the forward portion 204 of the insert 72. Eight such contact channels 214 are shown in FIG. 6. As seen, each contact channel 214 extends generally parallel to the opposing side faces 210*a*, 210*b* of the housing 10, as well as generally parallel to the upper and lower faces 210*c*, 210*d* of such housing 10. As should be evident, each contact channel 214 can receive (although does not necessarily receive) at least a portion of a first contact 206 (i.e. a 'long' contact) therein.

As should be evident, then, if the jack 200 of the present invention has X contact positions 214 and Y groups 212, such jack 200 can accommodate a maximum of X−Y+1 first contacts 206. Of course, the jack 200 could be loaded with a lesser amount of contacts 206 without departing from the spirit and scope of the present invention, in which case additional unused contact positions 214 are present.

Figure 6B:
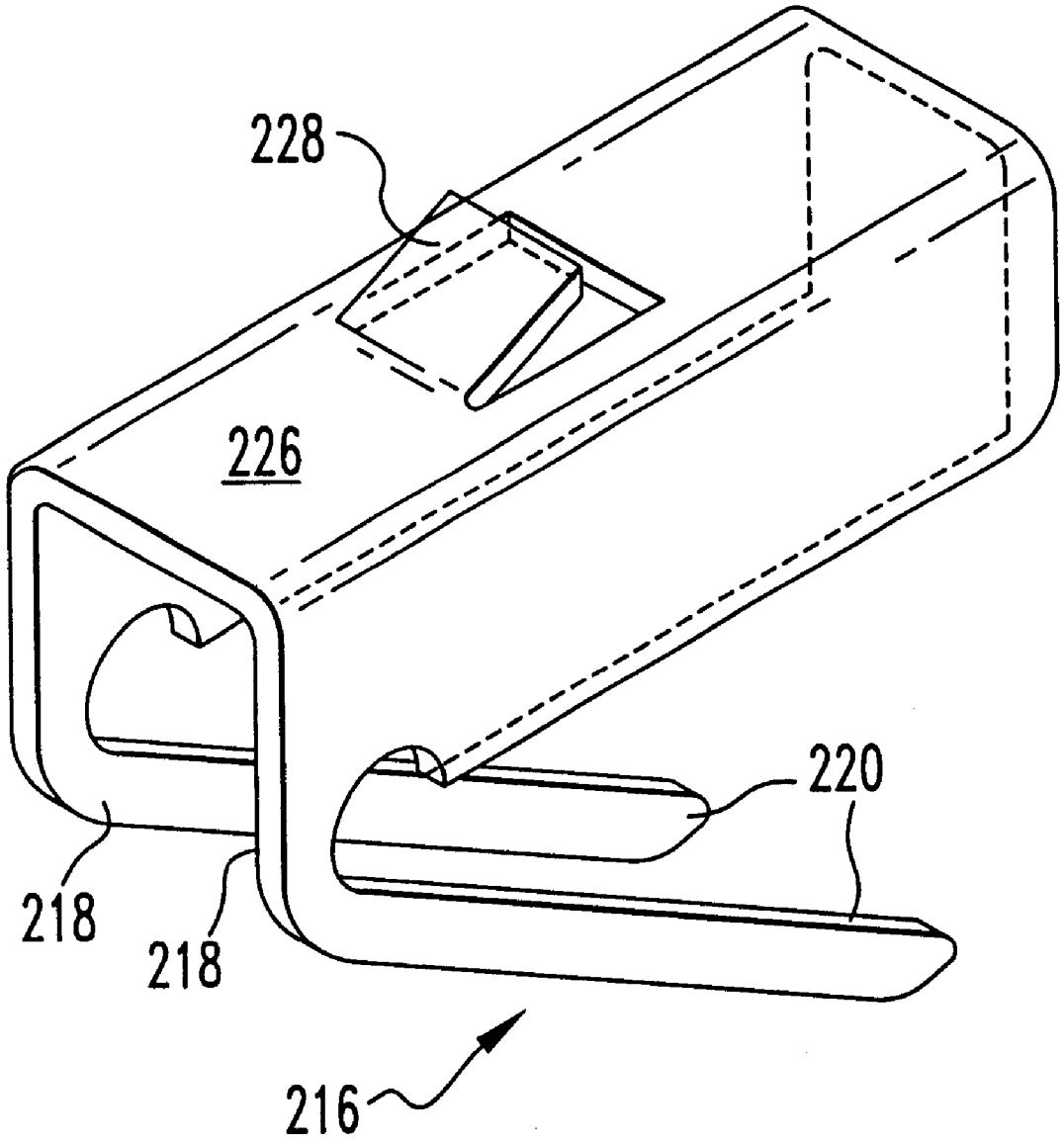
FIG. 6B is a perspective view of the internal shield device of FIG. 6.

Importantly, to minimize cross-talk in the present invention, each group 212 is shielded from an immediately adjacent group 212 by a conductive internal shield device 216 which includes at least one separator 218, as is seen in FIGS. 6–6B (where the shield device 216 has two separators 218). Preferably, the shield device 216 is formed from a conductive shielding material such as a copper alloy, although any other appropriate conductive shield material may also be employed. It is expected that the shield device 216 will be created by one or more stamping, folding and/or forming operations, although other methods may also be employed. For example, the shield device 216 may be extruded or molded into its final form.

As shown, each separator 218 of the shield device 216 resides in an unused contact position 214 and is positioned to be in a plane generally parallel to the plane of each first contact 206 in the jack 200. In other words, separator 218 mimics a contact placed in the unused contact positions. Separator could engage a corresponding conductor in plug 208, or merely reside within a channel lacking a conductor. Accordingly, each separator 218 in fact performs the aforementioned shielding function, electromagnetic interference generated by a group 212 on side of the separator 218 is prevented from substantially affecting a group 212 on the other side of the separator 218, and cross-talk is thus minimized.

Typically, the shield device 216 is inserted into the jack 200 by inserting each separator 218 thereof down through the upper face 210*c* of the housing 10/jack 200 and into and through the corresponding unused contact position 214 in a direction generally perpendicular to the extending contact channels 214. Accordingly, a separator receiving slot (not shown) must be present in the region of such corresponding unused contact position 214. As maybe appreciated, such slot may reside in the insert 72, the housing 10, or both the insert 72 and the housing 10. In one embodiment of the present invention, such slot is formed during the formation of the housing 10 and/or the insert 72. In another embodiment, the slot is formed after such formation by appropriate machining in a known manner. Owing to the fact that each groove 104, 106 in the insert 72 may have a non-linear aspect at the top face thereof, as is seen in FIG. 4, each slot is referenced to a respective groove 104, 106, but need not necessarily be precisely aligned with such groove 104, 106 at such top face.

In one possible application of the present invention, then, and as seen in FIGS. 6–6B, if eight contact positions 214 are available, if positions 3 and 6 (as numbered from left to right) are designated as receiving separators 218, then three groups 212 of first contacts 206 (C) are available in the jack 200: a first group at 1–2, a second group at 4–5, and a third group at 7–8 in the following arrangement:

| 1 | 2 | 3 | 4 | 5 | 6 | 7 | 8 |
|---|---|---|---|---|---|---|---|
| $C_{short}$ | $C_{long}$ | S | $C_{short}$ | $C_{long}$ | S | $C_{short}$ | $C_{long}$ |

Preferably, each group 212 of contacts has one 'short' contact ($C_{short}$) and one 'long' contact ($C_{long}$). However, other contact arrangements are possible.

Furthermore, separators 218 need not create a symmetrical arrangement. For example, the following arrangement is one possibility:

| 1 | 2 | 3 | 4 | 5 | 6 | 7 | 8 |
|---|---|---|---|---|---|---|---|
| $C_{short}$ | S | $C_{long}$ | $C_{long}$ | $C_{long}$ | S | $C_{long}$ | $C_{long}$ |

In this instance, all of the contacts could be long contacts.

As best seen in FIGS. 6A–6B, the planar extent of each separator 218 need not necessarily be especially large to achieve the aforementioned shielding function. Instead, and as shown, the separator 218 need only extend planarly enough to substantially minimize if not completely remove direct 'line of sight' interaction between corresponding portions of the first contacts 206 on either side of such separator 218. Thus, if the separated first contacts 206 each have a first portion on top of the forward portion 204 of the insert 72, a second, connecting portion curving around the forward portion 204, and a third portion below the forward portion 204, then the separating separator 218 preferably has portions corresponding to such first, second, and third portions, as is shown.

Typically, each first contact 206 in the jack is springed in the area where contact is to be made with a corresponding conductor (not shown) of a connector 208 to be received in the jack 200, where the springed portion corresponds to the third portion below the forward portion 204 of the insert 72, as was discussed above. As is to be understood, the springed portion of each first contact 206 allows for springing contact with the corresponding conductor, thereby spring-loading such springed portion and minimizing the chance that such conductor is damaged by such contact, among other things.

As should be understood, each separator 218 will also make contact with a corresponding conductor (not shown) of such connector 208. Accordingly, in one embodiment of the present invention, each separator 218 of the shield device 216 has a springed portion 220 corresponding to the springed portion of each first contact 206. Thus, like the springed portion of each first contact 206, the springed portion 220 of each separator 218 allows for springing contact with the corresponding conductor, thereby spring-loading the springed portion 220 of the separator 218 and minimizing the chance that such conductor is damaged by such contact, among other things. Such springed portion may be unnecessary, for example, if the mating connector 208 lacks a corresponding conductor, or if a different conductor is employed to engage the internal shield 216.

In one embodiment of the present invention, and as seen in FIGS. 6–6B, the jack 200 has a conductive external jack shield 222 that is fitted over the housing 10. As is to be understood, the jack shield 222 substantially shields the jack 200 from externally originating electromagnetic interference, and also shields the exterior of the jack 200 from electromagnetic interference that originates from within the jack 200. Preferably, the jack shield 222 is formed from a conductive shielding material such as a copper alloy, although any other appropriate conductive shield material may also be employed. It is expected that the jack shield 222 will be assembled by one or more stamping, forming, and/or folding operations, although other assembling methods may also be employed. For example, the jack shield 222 may be extruded or molded into its final form.

Preferably, the jack shield 222 is electrically grounded by way of an underlying substrate 224 (FIG. 6A), and the shield device 216 is in conductive contact with the jack shield 222. Accordingly, the shield device 216 and each separator 218 thereof is also electrically grounded.

In one embodiment of the present invention, and as seen in FIGS. 6–6B, the shield device 216 includes a base member 226 coupled to each separator 218, where the base member 226 generally resides in a plane generally parallel to the upper and lower faces 210*c*, 210*d* of the housing 10/jack 200, and is generally perpendicular with respect to each attached separator 218. Accordingly, when the shield device 216 is pushed down into the upper face 210*c* of the housing 10/jack 200, the base member 226 generally overlays at least one of the contact positions 214 in the insert 72.

In one embodiment of the present invention, the base member 226 of the shield device 216 is generally positioned at the upper face 210*c* of the jack 200/housing 10. To accommodate the base member 226, a receiving space is preferably formed in the housing 10, insert 72, or both, either during the formation of the housing 10 and/or the insert 72, or else after such formation by appropriate machining in a known manner.

With the shielding device 216 having the base member 226 properly inserted into the housing 10/jack 200, and the base member 226 at the upper face 210*c*, the aforementioned conductive external jack shield 222 may then be fitted over the housing 10 such that the base member 226 of the shield device 216 is in conductive contact with the jack shield 222. In one embodiment of the present invention, the base member 226 of the shield device 216 includes a projection 228 projecting from the upper face 210*c* toward the jack shield 222 to ensure contact therewith. Preferably, to ensure that a good quality contact is achieved, the projection 228 is springed, whereby contact between the springed projection 228 and the jack shield 222 spring-loads such springed projection 228. The projection 228 may be formed by any appropriate method. For example, the projection 228 may be stamped from the shield device 216 during formation of such shield device 216.

Figure 6C:
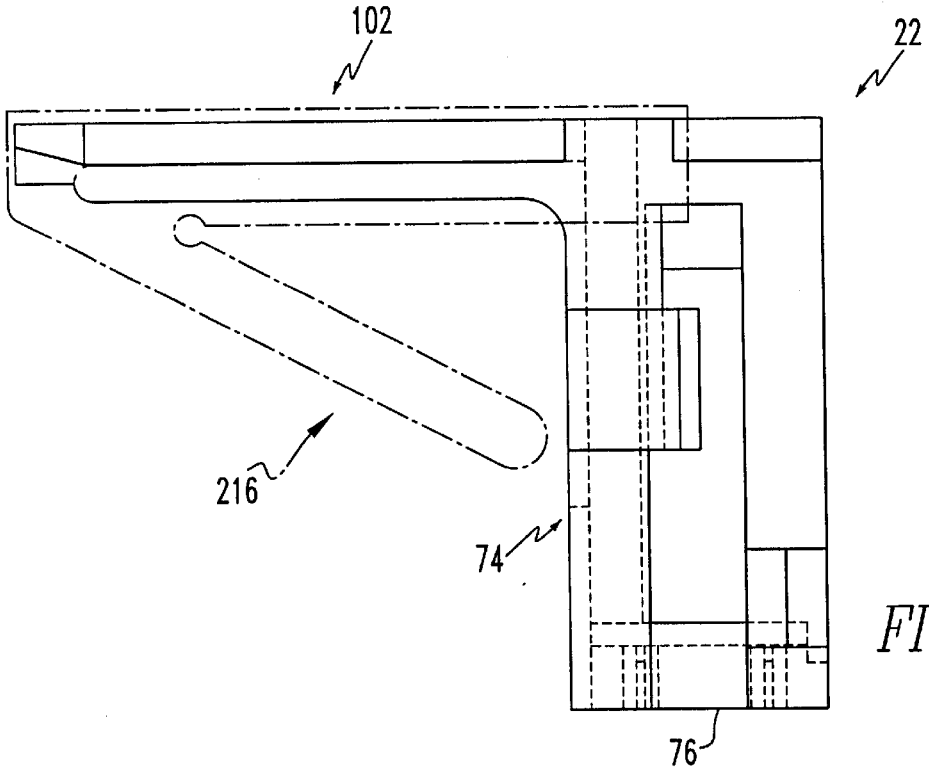
FIGS. 6C and 6D are side elevational views of the insulative insert of the modular jack of FIG. 6 in variations on the first embodiment of the present invention.
Figure 6D:
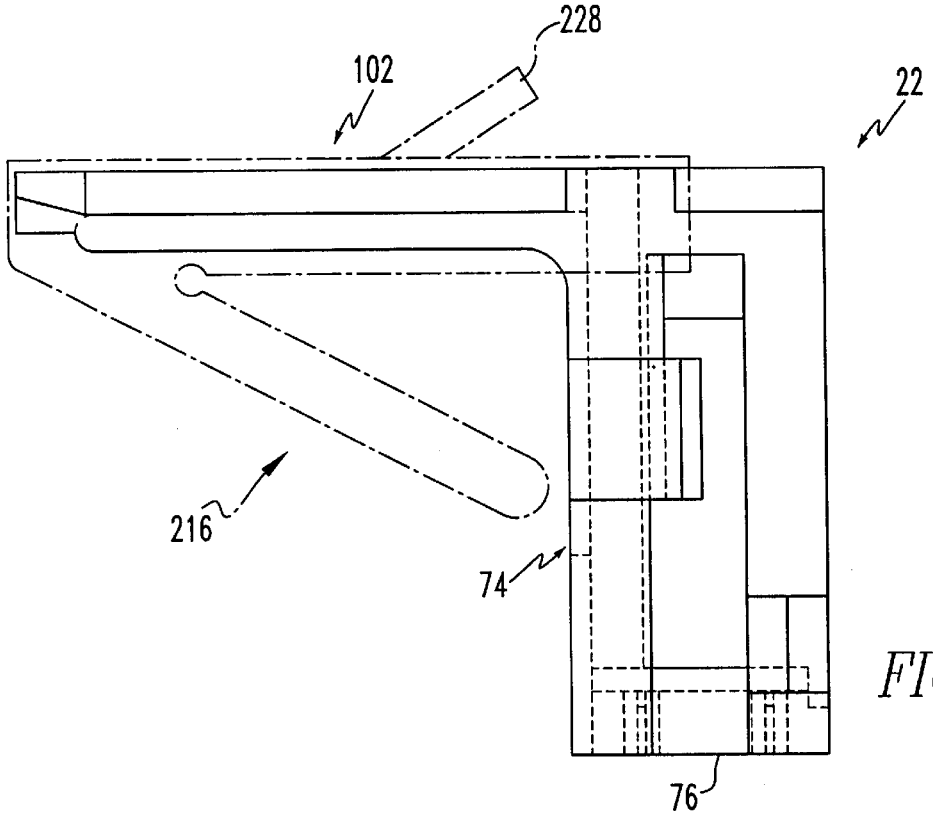

In a variation on the embodiment of the present invention shown in FIGS. 6–6B, and as seen in FIG. 6C, the shield device 216 (shown in phantom) is inserted down through the insert 72 of the jack 200 only, and not through the housing 10. As should be understood, such a situation may require that the shield device 216 be inserted into the insert 72 prior to insertion of the insert 72 into the housing 10. In another variation on the embodiment of the present invention shown in FIGS. 6–6B, and as seen in FIG. 6D, the shield device 216 (shown in phantom) is inserted from the rear face of the insert 72 thereinto, and again not through the housing 10. As should be understood, in such a situation, the base member 226 would face toward the rear of the insert 72 and jack 200, rather than toward the upper face as in FIGS. 6–6C. In the variations shown in FIGS. 6C and 6D, each shield device 216 may be provided with a suitable projection 228 (shown in FIG. 6D) to contact a jack shield 222. Such a suitable projection 228 may however require suitable access through the corresponding insert 72 and/or housing 10 if such jack shield 222 is not physically adjacent any part of the shield device 216.

Figure 7:
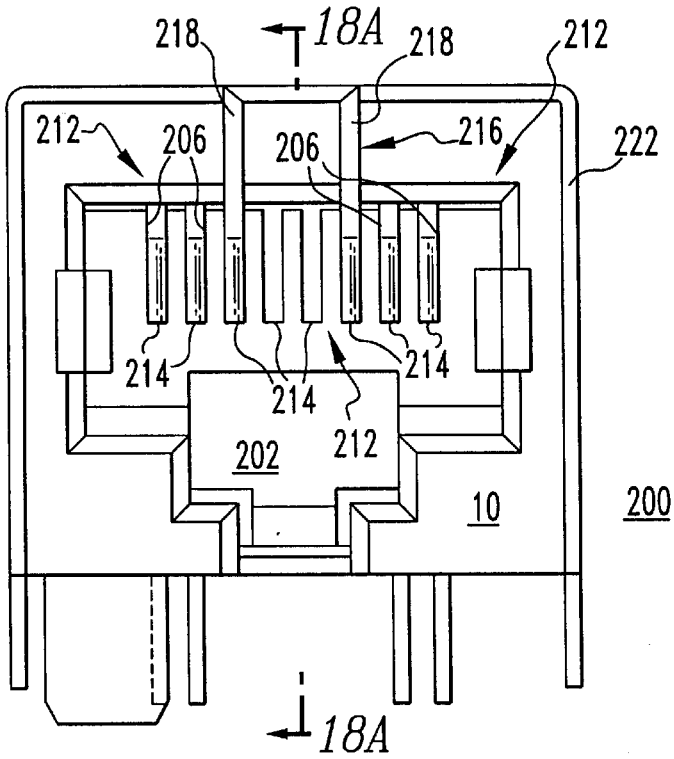
FIG. 7 is a front elevational view of a modular jack with internal shield device in accordance with a second embodiment of the present invention.
Figure 7A:
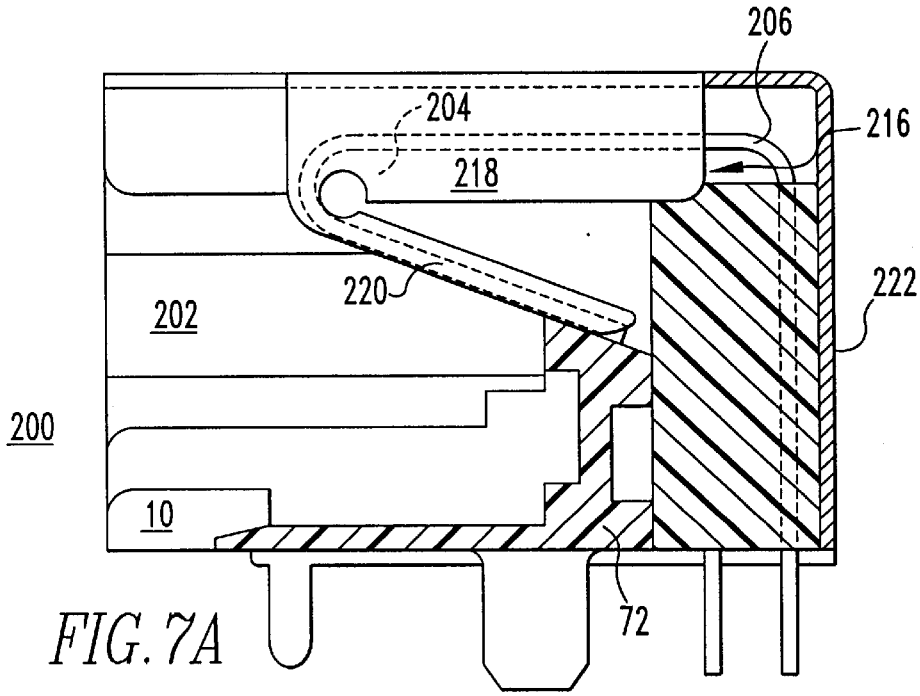
FIG. 7A is a cross-sectional view taken along the line 7A—7A in FIG. 7.
Figure 7B:
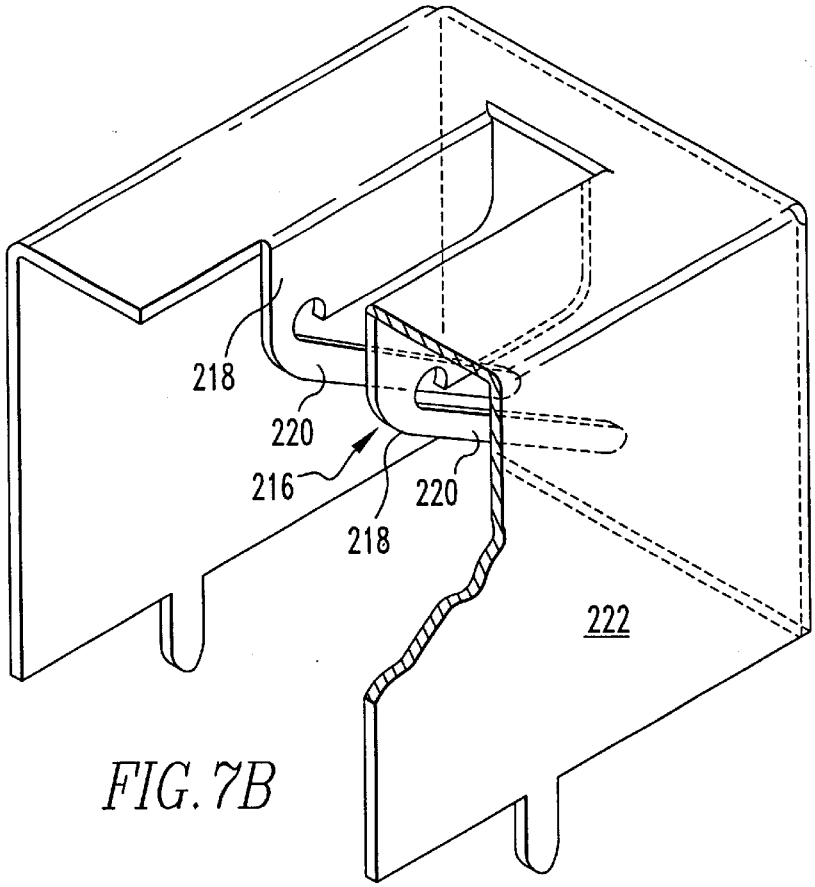
FIG. 7B is a partially broken-away perspective view of the unitary internal shield device and external jack shield of FIG. 7.

Referring now to FIGS. 7–7B, it is seen that in a second embodiment of the present invention, the external jack shield 222 and the internal shield device 216 are formed as a substantially unitary body by an appropriate stamping and forming operation, and are thus mounted to the jack 200 as the substantially unitary body. Notably, in the jack 200 shown in FIGS. 7–7B, no base member 226 is present as the separators 218 are coupled directly to the jack shield 222. Likewise, no projection 228 is present.

In one possible application of the present invention, then, and as seen in FIGS. 7–7B, if eight contact positions 214 are available, if positions 4 and 5 (as numbered from left to right) are designated as unused by either contacts or separators, if two separators 218 (appropriately spaced) are inserted into slots 3 and 6, then two groups 212 of first contacts 206 are available in the jack 200: a first group at 1–2 and a second group at 7–8. Importantly, since the jack shield 222 exposes contact positions 4 and 5, contact positions 4 and 5 are not shielded by the jack shield 222, and therefore positions 4 and 5 are not loaded. As shown in FIGS. 7–7B, then, each group 212 is separated from the other by four immediately adjacent unused contact positions 214, and each separator 218 resides in an unused contact position 214 immediately adjacent a respective group 212. As specifically shown in FIGS. 7 and 7*a*, contacts 206 are long contacts and the arrangement is as follows:

| 1 | 2 | 3 | 4 | 5 | 6 | 7 | 8 |
|---|---|---|---|---|---|---|---|
| $C_{long}$ | $C_{long}$ | S | — | — | S | $C_{long}$ | $C_{long}$ |

If jack 200 used long and short contacts, then a possible arrangement could be as follows:

| 1 | 2 | 3 | 4 | 5 | 6 | 7 | 8 |
|---|---|---|---|---|---|---|---|
| $C_{long}$ | $C_{long}$ | S | — | — | S | $C_{long}$ | $C_{long}$ |

If, however, contact positions 4 and 5 were shielded by the jack shield 222 by appropriate shielding (such as, for example, shield 222 was stamped and formed in a different manner so as to provide shielding over positions 4 and 5), such positions could be loaded with contacts 206 to form another group 212.

Figure 8A:
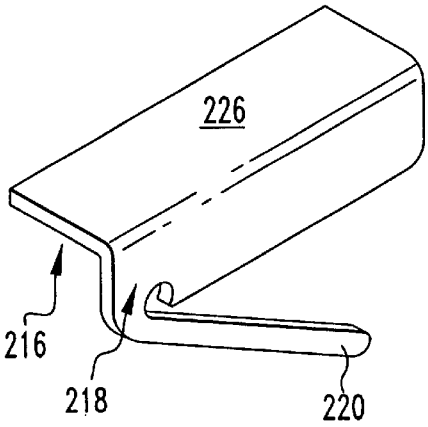
FIGS. 8A and 8B are perspective views of internal shield devices employed in accordance with third and fourth embodiments of the present invention.
Figure 8B:
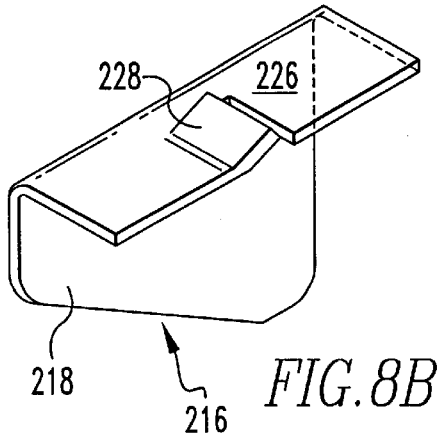

Referring now to FIGS. 8A and 8B, in third and fourth embodiments of the present invention, the shield device 216 need only have a single separator 218 attached to a base member 226 (FIGS. 8A and 8B), the projection 228 need not necessarily be employed (FIG. 8A), and the separator 218 need not necessarily be springed (FIG. 8B). Of course, with only a single separator 218, only two groups 212 can be formed thereby. The present invention could use, however, more than one of individual separators shown in FIGS. 8A and 8B.

As shown in FIGS. 8A and 8B, the base member 226 of the single separator shield device 216 may extend toward either side face 210*a*, 210*b* (FIG. 8A, FIG. 8B, respectively) from the separator 218), depending on convenience and based on which contact position 214 the separator is to be positioned in. For example, if the separator 218 is to be in contact position 3, having the base member overlay at least contact position 4 (by using the shield device 216 of FIG. 8B) is most likely desired.

As should now be understood, practically any appropriate shielded arrangement may be employed. For example, if eight contact positions 214 are available, if position 3 (as numbered from left to right) receives a separator 218, then two groups 212 of first contacts 206 are available in the jack 200: a first group at 1–2 and a second group at 4–5–6–7–8. Several possible arrangements are shown below:

| 1 | 2 | 3 | 4 | 5 | 6 | 7 | 8 |
|---|---|---|---|---|---|---|---|
| $C_{short}$ | $C_{long}$ | S | $C_{long}$ | $C_{short}$ | $C_{short}$ | $C_{long}$ | $C_{long}$ |
| $C_{long}$ | $C_{long}$ | S | $C_{long}$ | $C_{long}$ | $C_{short}$ | $C_{long}$ | $C_{long}$ |

In the present invention, a jack 200 can receive a shield device 216, thereby forming a plurality of shielded contact groups 212 therein where cross-talk between such groups 212 is minimized. Such jack 200 with such shielded contact groups 212 may then be employed in a relatively high speed application. While the present invention has been described in connection with the embodiments as shown in FIGS. 6–8B, it is to be understood that other similar embodiments may be used or modifications and additions may be made to the described embodiments for performing the same function of the present invention without deviating therefrom. Therefore, the present invention should not be limited to any single embodiment, but rather construed in breadth and scope in accordance with the recitation of the appended claims.

What is claimed is:

1. An electrical connector comprising:

an insulating housing having an interior cavity for receiving a mating connector and a plurality of openings in communication with the interior cavity;

a plurality of contacts, each extending into the interior cavity of the housing from a respective one of the openings, for electrically contacting conductors in the mating connector inserted into the interior cavity of the housing; and an internal shield extending into the interior cavity and between the contacts to separate the contacts into a plurality of groups.

2. The connector of claim 1, wherein the internal shield separates the contacts into at least three groups.

3. The connector of claim 1 wherein the plurality of openings are generally parallel.

4. The connector of claim 1 wherein the internal shield includes two separators, each separator residing in an unused contact position immediately adjacent a respective group.

5. The connector of claim 1 wherein the internal shield includes a resilient section engaged by the mating connector during insertion thereof into the cavity.

6. The connector of claim 1 wherein the housing includes a removable insert positioned therein.

7. The connector of claim 1 wherein the connector is a modular jack.

8. The connector as recited in claim 1, wherein the internal shield extends into the interior cavity from at least one of the openings.

9. The connector of claim 1 further comprising an external shield generally surrounding the housing.

10. The connector of claim 9 wherein the external shield is in conductive contact with the internal shield.

11. The connector of claim 10 wherein the external shield and the internal shield are formed as a substantially unitary body.

12. The connector of claim 1 wherein the housing further has an upper face and wherein the internal shield includes a base member located adjacent the upper face and at least one separator extending from the base member and into the interior cavity.

13. The connector of claim 12 wherein the base member includes a projection projecting away from the housing.

14. A modular jack comprising:

an insulating housing having an interior cavity;

a plurality of contacts extending into the interior cavity of the housing for electrically contacting conductors in a mating connector inserted into the interior cavity of the housing, each contact having a mating portion, and the contacts being organized into a plurality of groups, each group comprising a number of immediately adjacent contacts, each group being separated from an immediately adjacent group by at least one unused contact position; and a conductive internal shield residing in the at least one unused contact position and being generally aligned with the mating portions of the contacts, to shield the immediately adjacent groups from one another.

15. The jack of claim 14 wherein the internal shield resides in a plurality of unused contact positions.

16. The jack of claim 14 wherein the internal shield resides in at least two unused contact positions.

17. The jack of claim 14 further comprising a conductive external shield fitted over the housing, the internal shield being in conductive contact with the external shield.

18. The jack of claim 17 wherein the external shield and the internal shield are formed as a substantially unitary body.

19. The jack as recited in claim 14, wherein the insert is generally L-shaped with a rear section and an upper section transverse to the rear section, the internal shield residing on the upper section.

20. The jack of claim 23 wherein the contacts are organized into at least two groups, each group comprising a pair of immediately adjacent contacts, each group being separated from the other by at least one unused contact position, and wherein the internal shield resides in an unused contact position between the groups.

21. The jack of claim 14 wherein the housing comprises a base and an insert receivable in the base, the insert carrying the contacts.

22. The jack of claim 21, wherein the insert carries the internal shield.

23. The jack of claim 14 wherein the housing defines eight possible contact channels.

24. The jack of claim 14 wherein the internal shield comprises at least one separator extending into the interior of the housing and a base member coupled to each separator, the base member being generally parallel to an upper face of the housing.

25. The jack of claim 24 further comprising a conductive external shield fitted over the housing, the base member of the internal shield being in conductive contact with the external shield.

26. The jack of claim 25 wherein the base member of the internal shield includes a projection extending toward the external shield to ensure contact therewith.

27. An electrical connector system, comprising:

a plug connector, including:
- a housing having a plurality of openings therein; and
- a plurality of contacts disposed in at least some of said openings; and
- a receptacle connector, including:
  - a housing having a cavity for receiving said plug;
  - a plurality of terminals, each extending into said cavity for engaging a corresponding one of said plurality of plug contacts; and
  - a shield extending into said cavity and entering at least one of said plurality of openings during mating.

28. The electrical connector system as recited in claim 27 wherein said plug and receptacle connectors are modular jack plug and receptacle connectors.

29. The electrical connector system as recited in claim 27 wherein said shield includes a resilient section deflected by said plug connector during mating.

30. The electrical connector system as recited in claim 27, wherein the shield extends into at least one unused contact position located between adjacent contacts.

31. The electrical connector system as recited in claim 27 wherein said shield engages a corresponding one of said plurality of plug contacts during mating.

32. The electrical connector system as recited in claim 27 wherein said cavity of said receptacle connector includes latch structure and said plug connector includes a latch that engages said latch structure for retaining said plug connector within said receptacle connector.

33. The electrical connector system as recited in claim 27 wherein said receptacle connector further comprises an external shield generally surrounding said housing.

34. The electrical connector system as recited in claim 33, wherein the shield and the exterior shield are unitary.

35. An electrical connector comprising:

a housing having:
- an interior cavity;
- a mating face having an opening in communication with the interior cavity to allow entry of a mating connector into the interior cavity; and
- a face transverse to the mating face;

a plurality of contacts extending into the interior cavity of the housing for electrically contacting conductors in the mating connector inserted into the interior cavity of the housing; and an internal shield extending into the interior cavity, the internal shield including
- a base member located adjacent the face; and
- a least one separator extending from the base member and into the interior cavity.

36. The electrical connector as recited in claim 35, wherein the face is an upper face.

37. An electrical connector comprising:

a housing having an interior cavity for receiving a mating connector and a plurality of openings in communication with the interior cavity;

a plurality of contacts, each extending into the interior cavity of the housing from a respective one of the openings, for electrically contacting conductors in the mating connector inserted into the interior cavity of the housing; and an internal shield comprising a plurality of separators extending into unused contact positions in the interior cavity to separate the contacts into groups.

38. An electrical connector system, comprising:

a plug connector, including:
- a housing having a plurality of openings therein; and
- a plurality of contacts disposed in at least some of said openings; and a receptacle connector, including:
  - a housing having a cavity for receiving said plug;
  - a plurality of terminals, each extending into said cavity for engaging a corresponding one of said plurality of plug contacts; and
  - a shield extending into at least one unused contact position within said cavity and entering at least one of said plurality of openings during mating.

39. In a receptacle connector having a cavity and conductive elements extending into the cavity to engage a mating connector, wherein the improvement comprises at least one of the conductive elements being an internal shield located between adjacent conductive elements to separate the conductive elements into groups.

* * * * *